US005677653A

United States Patent [19]

Särkkä

[11] Patent Number: 5,677,653

[45] Date of Patent: Oct. 14, 1997

[54] COMBINED COARSE AND FINE DIELECTRIC RESONATOR FREQUENCY TUNING MECHANISM

[75] Inventor: Veli-Matti Särkkä, Oulunsalo, Finland

[73] Assignee: Nokia Telecommunications Oy, Espoo, Finland

[21] Appl. No.: 640,795

[22] PCT Filed: Oct. 4, 1995

[86] PCT No.: PCT/FI95/00547

§ 371 Date: Jun. 4, 1996

§ 102(e) Date: Jun. 4, 1996

[87] PCT Pub. No.: WO96/11511

PCT Pub. Date: Apr. 18, 1996

[30] Foreign Application Priority Data

Oct. 5, 1994 [FI] Finland ..... 944663

[51] Int. Cl.[6] ..... H01P 7/10

[52] U.S. Cl. ..... 333/235; 333/219.1

[58] Field of Search ..... 333/219.1, 235, 333/231–233, 223–226

[56] References Cited

U.S. PATENT DOCUMENTS 4,019,161 4/1977 Kimura et al. ..... 333/219.1 X 4,565,979 1/1986 Fiedziuszko ..... 331/117 D

FOREIGN PATENT DOCUMENTS 0 519 308 12/1992 European Pat. Off. ..... 333/219.1

*Primary Examiner*—Benny T. Lee

*Assistant Examiner*—Barbara Summons

*Attorney, Agent, or Firm*—Cushman Darby & Cushman Intellectual Property Group of Pillsbury Madison & Sutro LLP

[57] ABSTRACT

A dielectric resonator including a dielectric resonator body and a frequency controller for adjusting the resonance frequency by moving a conductive metal plane in the vicinity of the dielectric resonator body. The frequency controller has a cylindrical supporting block connected to a casing, and a second cylindrical supporting block gliding telescopically inside it by means of friction surfaces. To this second cylindrical supporting block, a ring-shaped conductive adjustment plane is connected. A second conductive adjustment plane, in turn, is connected to the adjustment mechanism and arranged in a center hole of the ring-shaped adjustment plane and attached to the second supporting block in a manner which transfers the movement of the adjustment mechanism so that it first moves the second adjustment plane for a predetermined adjustment range, and thereafter both adjustment planes together. Thus, the frequency controller has two slopes of adjustment, whereby the adjustment is fast, owing to the movement of both adjustment planes, and also extremely accurate, owing to the fine adjustment function, which is achieved when the smaller adjustment plane is moved alone.

4 Claims, 2 Drawing Sheets

COMBINED COARSE AND FINE DIELECTRIC RESONATOR FREQUENCY TUNING MECHANISM

This application claims benefit of international application PCT/F195/00547, filed Oct. 4, 1995, published as WO96/11511 Apr. 18, 1996.

BACKGROUND OF THE INVENTION

The invention relates to a dielectric resonator comprising a dielectric body having at least one planar surface, a frequency controller comprising an adjustment mechanism and an electrically conductive adjustment plane, which is substantially parallel with the planar surface of the dielectric body and movable by means of the adjustment mechanism in the perpendicular direction with respect to the resonator discs for adjusting the resonance frequency by changing the distance between the adjustment plane and the planar surface of the dielectric body, and an electrically conductive casing.

Recently, so-called dielectric resonators have become more and more interesting in high frequency and microwave range structures, as they provide the following advantages over conventional resonator structures: smaller circuit sizes, higher degree of integration, improved performance and lower manufacturing costs. Any object which has a simple geometric shape, and the material of which exhibits low dielectric losses and a high relative dielectric constant may function as a dielectric resonator having a high Q value. For reasons related to manufacturing technique, a dielectric resonator is usually of a cylindrical shape, such as a cylindrical disc.

The structure and operation of dielectric resonators are disclosed e.g. in the following articles:

[1] "Ceramic Resonators for Highly Stabile Oscillators", Gundolf Kuchler, Siemens Components XXIV (1989) No. 5, p. 180–183.

[2] "Microwave Dielectric Resonators", S. Jerry Fiedziuszko, Microwave Journal, September 1986, p. 189–189.

[3] "Cylindrical Dielectric Resonators and Their Applications in TEM Line Microwave Circuits", Marian W. Pospieszalski, IEEE Transactions on Microwave Theory and Techniques, VOL. MTT-27, NO. 3, March 1979, p. 233–238.

The resonance frequency of a dielectric resonator is primarily determined by the dimensions of the resonator body. Another factor that has an effect on the resonance frequency is the environment of the resonator. By bringing a metallic or any other conductive surface to the vicinity of the resonator, it is possible to intentionally affect the electric or magnetic field of the resonator, and thus the resonance frequency. In a typical method for adjusting the resonance frequency of the resonator, the distance of a conductive metallic surface from the planar surface of the resonator is adjusted. One prior art dielectric filter design of this kind is shown in FIG. 1, in which a resonator comprises inductive coupling loops 5 (input and output), a dielectric resonator disc 3 installed in a metal casing 4 and supported by a dielectric leg 6, and a frequency controller attached to the metal casing 4, comprising an adjustment screw 1 and a metal plane 2. The resonance frequency of the resonator depends on the distance L between the resonator disc 3 and the metal plane 2 in accordance with a graph in FIG. 2.

As appears from FIG. 2, frequency adjustment is based on a highly accurate mechanical movement, the slope of adjustment k also being steep. When the resonance frequency becomes higher, e.g. to the range 1500–2000 MHz or higher, the dimensions of the basic elements of the dielectric filter, such as those of the resonator disc 3 or the adjustment mechanism 1,2 are reduced. As a result, adjusting the resonance frequency of a dielectric resonator with prior art solutions sets very high demands on the frequency adjustment mechanism, which, in turn, increases the material and production costs. In addition, as the mechanical movements of the frequency adjustment device must be made very small, adjustment will be slower.

SUMMARY OF THE INVENTION

The object of the invention is to provide a dielectric resonator providing a higher adjustment accuracy and speed.

This is achieved with a dielectric resonator, which is characterized in accordance with the invention by the frequency controller further comprising

- a first cylindrical supporting block connected to the casing, and a second cylindrical supporting block gliding telescopically along friction surfaces inside the first block,
- a ring-shaped electrically conductive adjustment plane connected to the second cylindrical supporting block, and
- a second electrically conductive adjustment plane connected to the adjustment mechanism and arranged to be located in the center hole of the ring-shaped adjustment plane and to be connected to the second supporting block in a manner which transfers the movement of the adjusting mechanism so as to first move the second adjustment plane with respect to the planar surface of the ceramic body for a predetermined adjustment range, and thereafter both the ring-shaped adjustment plane and the second adjustment plane.

The resonator of the invention consists of a pair of joined adjustment planes, such as metal planes, which are mechanically engaged with each other so that their movement with respect to each other and the ceramic body provides two adjustment phases during one adjusting movement. At the beginning of the adjusting movement, the smaller adjustment plane moves a predetermined distance with respect to the larger adjustment plane and the dielectric body, while the larger adjustment plane remains stationary by means of a specific friction surface. Once the smaller adjustment plane has moved the predetermined distance, the larger adjustment plane also starts to move in accordance with the adjusting movement. Thus, a dielectric resonator is achieved, the frequency controller of the resonator having two slopes of adjustment, whereby the adjustment is fast owing to the movement of both adjustment planes, and also extremely accurate owing to the fine adjustment function, which is achieved when the smaller adjustment plane is moved alone. By means of the invention, the adjustment accuracy may be improved as much as tenfold, so that the demands on the accuracy of the adjustment mechanics do not have to be made stricter when the frequency is increased, or they may be even moderated for the presently used frequencies.

BRIEF DESCRIPTION OF THE DRAWINGS

In the following, the invention will be disclosed in greater detail by way of example with reference to the attached drawings, in which.

DETAILED DESCRIPTION

The structure, the operation and the ceramic manufacturing materials of dielectric resonators are disclosed e.g. in the above-mentioned articles [1], [2], and [3], which are incorporated herein by reference. In the following description, only the parts in the structure of the dielectric resonator which are essential to the invention will be disclosed.

The term dielectric resonator body, as used herein, generally refers to any object which has a suitable geometric shape, and the manufacturing material of which exhibits low dielectric losses and a high relative dielectric constant. For reasons related to manufacturing technique, a dielectric resonator is usually of a cylindrical shape, such as a cylindrical disc. The most commonly used material is ceramic material.

Figure 1:
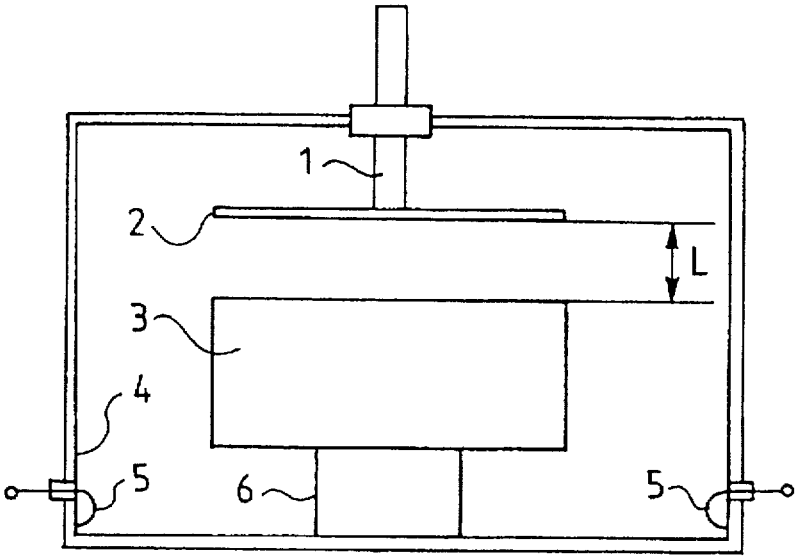
FIG. 1 (PRIOR ART)
FIG. 1 shows a cross-sectional side view of a prior art dielectric resonator.
Figure 2:
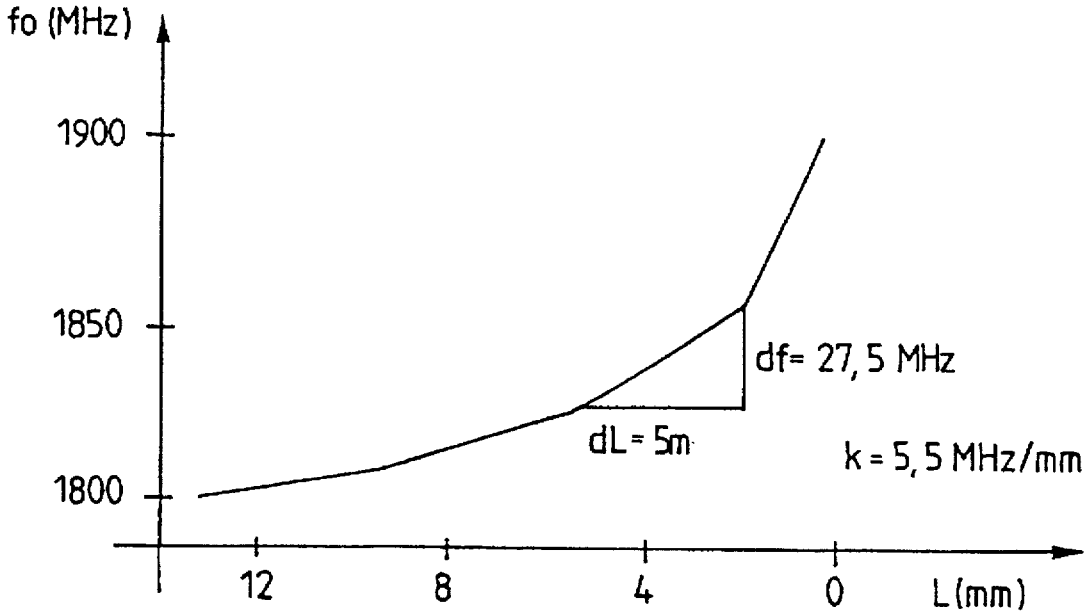
FIG. 2 (PRIOR ART)
FIG. 2 shows a graph illustrating the resonance frequency of the resonator shown in FIG. 1 as a function of distance L.
Figure 3:
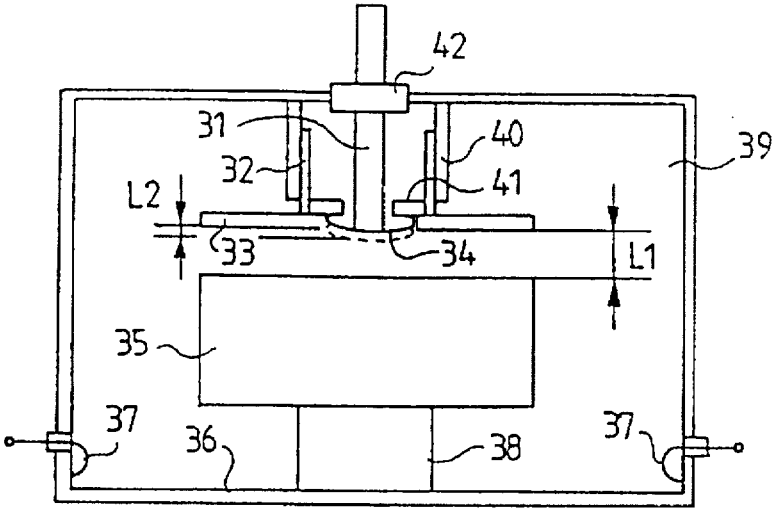
FIG. 3 shows a cross-sectional side view of a dielectric resonator of the invention.

FIG. 3 shows a dielectric resonator of the invention, comprising a dielectric, preferably cylindrical resonator disc 35 inside a casing 36 made of an electrically conductive material, such as metal, said disc being preferably ceramic and installed at a fixed distance from the bottom of the casing 36, on a supporting leg 38 of a suitable dielectric or isolating material. The casing 36 is coupled to the ground potential. The resonance frequency adjustment mechanism comprises adjustment plates 33 and 34 of metal (or some other electrically conductive material), an adjustment mechanism 31, and a bushing 42, as well as cylindrical supporting blocks 32 and 40, of isolating material.

The electromagnetic fields of a dielectric resonator extend beyond the resonator body, so it may easily be coupled electromagnetically to the rest of the resonator circuit in a variety of ways depending on the application, e.g. by means of a microstrip conductor in the vicinity of the resonator, a bent coaxial cable, a normal straight wire, etc. FIG. 3 shows by way of example coupling to the resonator by inductive coupling loops 37, which provide the input and the output of the resonator.

The resonator frequency of a dielectric resonator is primarily determined by the dimensions of the dielectric body 35. Another factor that has an effect on the resonance frequency is the environment of the dielectric body 35. By bringing a metallic or any other conductive surface to the vicinity of the resonator, it is possible to intentionally affect the electric or magnetic field of the resonator, and thus the resonance frequency. In the resonator shown in FIG. 3, adjustment plates 33 and 34 function as a conductive surface. In other words, the adjustment plane consists of two combined adjustment planes 33 and 34, which are mechanically engaged with each other so that their movement with respect to each other and with respect to the ceramic body provides two adjustment phases during one adjusting movement. At the beginning of the adjusting movement, the smaller adjustment plane 34 moves with respect to the larger adjustment plane 33 and the planar top surface of the dielectric body 35 a predetermined distance L2, while the larger adjustment plane remains stationary by means of a specific friction surface. Once the smaller adjustment plane has moved said distance L2, the larger adjustment plane 33 also starts to move in accordance with the adjusting movement.

In a preferred embodiment of the invention shown in FIG. 3, the frequency adjustment mechanism comprises a cylindrical supporting block 40, one end of which is connected to a casing 36. Inside supporting block 40, there is a second cylindrical supporting block 32 gliding telescopically on its inner surface. The inner surface of supporting block 40 and/or the outer surface of supporting block 32 is a friction surface so that a predetermined friction acts against the movement of supporting block 32. A ring-shaped adjustment plane made of metal or some other electrically conductive material is connected to the lower end of the cylindrical supporting block 32. The second adjustment plane 34 is connected to the lower end of an adjustment screw 31, and arranged to be located in the center hole of the ring-shaped adjustment plane 33 and to be connected to supporting block 32 in a manner which transfers the movement of the adjustment screw 31 so that it first moves adjustment plane 34 with respect to the planar surface of the resonator disc 35 for a predetermined adjustment range L2, and thereafter both the ring-shaped adjustment plane 33 and adjustment plane 34. Adjustment plane 34, which is preferably a bent ring-shaped metal film, is connected by its edges to a shoulder 41, and in the middle to the lower end of the adjustment screw 31. The adjustment screw 31 is connected by threads to a bushing 42 so that by turning the adjustment screw 31, it is possible to adjust the length of the screw 31 in an air-filled inside 39 of the casing 36, and thus the distance of adjustment planes 33 and 34 from the planar top surface of the resonator disc 35. The axial movement of the adjustment screw 31 first causes bending of the metal film 34, until bending reaches its maximum value, whereafter the movement of the adjustment screw 31 is transferred via the metal film 34, also into the movement of the ring-shaped adjustment plane 33.

Figure 4:
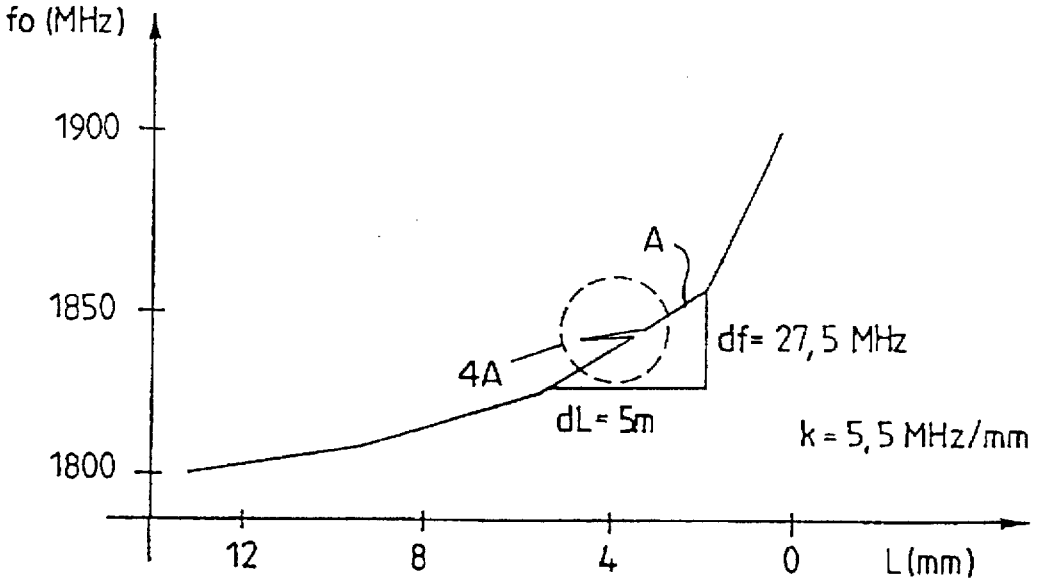
FIG. 4 shows a graph illustrating the resonance frequency of the resonator shown in FIG. 3 as a function of distance L.
Figure 4A:
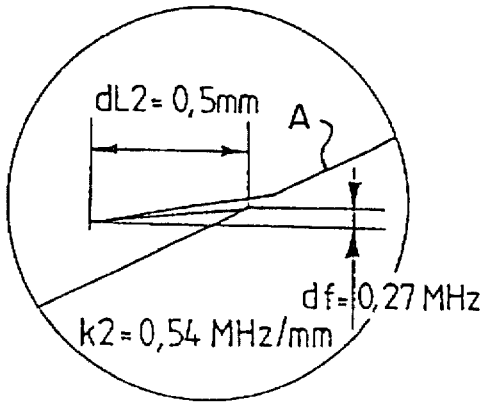
FIG. 4A shows an enlarged detail of the graph in FIG. 4.

Thus, a dielectric resonator is achieved the frequency controller of which has two slopes of adjustment, whereby the adjustment is fast when both adjustment planes 33 and 34 are moved, and slower, but extremely accurate when the smaller adjustment plane 34 is moved alone. The graph of FIG. 4 shows the resonance frequency fo of the resonator of the invention as a function of the movement L of the adjustment plane. In FIG. 4, curve A describes the adjustment when both adjustment planes are moved, the slope of adjustment k being e.g. 5.5 MHz/mm. At the circle marked with a broken line, fine adjustment is performed solely with a movement of adjustment plane 34, which is achieved by changing the rotating direction of the adjustment screw 31. An enlargement of a part of curve A corresponding to the fine adjustment situation is shown in FIG. 4A, from which appears that slope of adjustment k2 of fine adjustment is remarkably lower than k, e.g. 0.54 MHz/mm. The relation k2/k of the slopes of adjustment proportional to the relation of the areas of adjustment planes 33 and 34. In other words, it is possible to select the appropriate slopes of adjustment by selecting appropriate areas.

The figures and the explanation associated therewith are only intended to illustrate the above invention. The resonator of the invention may vary in its details within the scope of the attached claims.

I claim:

1. A dielectric resonator comprising:

a dielectric body comprising at least one planar surface;

a frequency controller comprising an adjustment mechanism and an electrically conductive adjustment plane, which is substantially parallel with the planar surface of the dielectric body and movable by means of the adjustment mechanism in a perpendicular direction with respect to the dielectric body for adjusting the resonance frequency by changing the distance between the adjustment plane and the planar surface of the dielectric body; and an electrically conductive casing said frequency controller further comprising:

a first cylindrical supporting block which is connected to the casing, and a second cylindrical supporting block gliding telescopically along friction surfaces inside the first block, a ring-shaped electrically conductive adjustment plane which is connected to the second cylindrical supporting block, and a second electrically conductive adjustment plane, which is connected to the adjustment mechanism and arranged in the centre hole of the ring-shaped adjustment plane and connected to the second supporting block in a manner which transfers the movement of the adjusting mechanism so as to first move the second adjustment plane with respect to the planar surface of the dielectric body for a predetermined adjustment range, and thereafter both the ring-shaped adjustment plane and the second adjustment plane.

2. The dielectric resonator as claimed in claim 1, wherein:

the second adjustment plane is a convexly bent ring-shaped metal film connected by edges thereof to the second supporting block, and connected in the middle thereof to one end of the adjustment mechanism, whereby movement of the adjustment mechanism first causes bending of the metal film until bending reaches a maximum value, whereafter movement of the adjustment mechanism is transferred via the metal film, also into movement of the ring-shaped adjustment plane.

3. The dielectric resonator as claimed in claim 1, wherein:

during movement of the ring-shaped adjustment plane, the frequency adjustment has a first slope of adjustment, and during movement of the second adjustment plane alone, the frequency adjustment has a second slope of adjustment, said second slope of adjustment being remarkably lower as compared with the first slope of adjustment.

4. A dielectric resonator as claimed in claim 1, wherein:

the adjustment mechanism comprises an adjustment screw.

* * * * *